US009708768B2

(12) United States Patent
Erkelenz et al.

(10) Patent No.: US 9,708,768 B2
(45) Date of Patent: Jul. 18, 2017

(54) SEALING STRIP FOR A PAPER, CARDBOARD OR TISSUE MACHINE MADE FROM A PLURALITY OF MATERIALS

(71) Applicant: VOITH PATENT GMBH, Heidenheim (DE)

(72) Inventors: Marc Erkelenz, Neu-Ulm (DE); Jochen Honold, Schlingen (DE); Helmut Bammer, Laarkirchen (AT)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 14/906,014

(22) PCT Filed: May 12, 2014

(86) PCT No.: PCT/EP2014/059591

§ 371 (c)(1),
(2) Date: Jan. 19, 2016

(87) PCT Pub. No.: WO2015/007414

PCT Pub. Date: Jan. 22, 2015

(65) Prior Publication Data

US 2016/0153141 A1 Jun. 2, 2016

(30) Foreign Application Priority Data

Jul. 19, 2013 (DE) ..... 10 2013 214 177

(51) Int. Cl.
*D21F 3/10* (2006.01)
*D21G 1/00* (2006.01)
*D21G 1/02* (2006.01)

(52) U.S. Cl.
CPC ..... *D21G 1/004* (2013.01); *D21F 3/10* (2013.01); *D21G 1/02* (2013.01)

(58) Field of Classification Search
CPC . D21F 3/10; D21G 1/00; D21G 1/004; D21G 1/02

(Continued)

(56) References Cited

U.S. PATENT DOCUMENTS 4,076,582 A * 2/1978 Burkhart ..... D21F 3/105 162/272
4,714,523 A * 12/1987 Sawyer, Jr. ..... D21F 3/10 162/369

(Continued)

FOREIGN PATENT DOCUMENTS

DE 102011004055 A1 8/2012
WO 2007003698 A1 1/2007

*Primary Examiner* — Mark Halpern
(74) *Attorney, Agent, or Firm* — Laurence A. Greenberg; Werner H. Stemer; Ralph E. Locher

(57) ABSTRACT

A sealing strip for a positive or negative pressure zone of a suction or blower roller of a machine for processing and/or producing web material, in particular a paper, cardboard or tissue machine. The sealing strip has a sealing face to be set against and in frictional contact with the inner side of a roller shell for sealing the positive or negative pressure zone during a rotational movement of the roller shell. The sealing strip has a lubricant channel in the form of a cutout from the sealing strip. The lubricant channel is arranged in front of the sealing face. The sealing strip is formed with a first material section at the sealing face and with a second material section at the front wall. The first and second materials are different in at least one physical property, such as modulus of elasticity, abrasion resistance, hardness, brittleness.

22 Claims, 4 Drawing Sheets

(58) Field of Classification Search
USPC ..... 162/373, 232, 289
See application file for complete search history.

(56) References Cited

U.S. PATENT DOCUMENTS

| | | | | |
|---|---|---|---|---|
| 5,975,532 | A * | 11/1999 | Karttunen | D21F 3/10 162/371 |
| 6,312,564 | B1 * | 11/2001 | Grabscheid | D21F 3/10 162/369 |
| 6,334,934 | B1 * | 1/2002 | Heinzmann | D21F 3/10 162/367 |
| 6,395,137 | B1 * | 5/2002 | Snellman | D21F 3/10 162/369 |
| 6,423,185 | B1 * | 7/2002 | Mantyla | C09D 5/1625 148/283 |
| 2009/0000753 | A1 | 1/2009 | Vestola et al. | |
| 2013/0328272 | A1 | 12/2013 | Honold | |

* cited by examiner

SEALING STRIP FOR A PAPER, CARDBOARD OR TISSUE MACHINE MADE FROM A PLURALITY OF MATERIALS

BACKGROUND OF THE INVENTION

Field of the Invention

The invention relates to a sealing strip which is suitable for use in a sealing device for sealing a positive or negative pressure zone of a suction or blower roller of a machine which processes and/or produces web material, in particular a paper, cardboard or tissue machine.

Sealing strips of the abovementioned type have been used for a long time in suction or blower rollers of a paper, cardboard or tissue machine, in order to seal positive or negative pressure zones with respect to the surroundings, by their sealing face being set against the inner side of the roller shell and being in frictional contact with the inner side of the roller shell during a rotational movement of the roller shell. In the sealing strips which have been known for a long time, lubrication of the sealing face/inner side of the roller shell friction pairing takes place by way of spray tubes which introduce a lubricant (as a rule, water) into the gap between the sealing face and the inner side of the roller shell. Systems of this type have the disadvantage that the lubricant often cannot be introduced effectively between the sealing face and the inner side of the roller shell and therefore a high quantity of lubricant is required for sufficient lubrication.

In the recent past, the applicant developed a novel sealing strip system, in which a lubricant channel with a front and a rear wall is machined in the sealing strip, which lubricant channel is arranged in front of the sealing face as viewed in the rotational movement direction of the roller shell, and by means of which lubricant channel the lubricant can be introduced directly into the inlet gap between the sealing face and the roller shell inner side.

For certain applications, such as applications in which the sealing strip is installed into the roller, for example, in a 5 to 12 o'clock position (in the case of a rotational movement direction of the roller shell counter to the clockwise direction), or in a 7 to 12 o'clock position (in the case of a rotational movement direction of the roller shell in the clockwise direction), it has now been shown that the front wall of the lubricant channel should advantageously be drawn up as far as or virtually as far as the inner side of the roller shell, in order to further improve the effectiveness of the discharge of the lubricant. This means that that material section of the sealing strip which provides the front wall can be in frictional contact with the roller shell inner side for said applications.

The material from which a customary sealing strip is produced is optimized for the provision of high abrasion resistance with the consequence that it often has a comparatively high modulus of elasticity and is often hard and brittle. Furthermore, the material thickness of the material section of the sealing strip in the region of the front wall is often very small. It can therefore occur that the sealing strip can fracture in the region of the front wall when the material section which provides the front wall is brought into frictional contact with the roller shell inner side.

BRIEF SUMMARY OF THE INVENTION

It is therefore the object of the present invention to further develop a sealing strip of the abovementioned type in such a way that it can be optimized both with regard to its abrasion resistance and also with regard to possible fracture of parts of the lubricant channel.

Said object is achieved by way of a sealing strip which is suitable for use in a sealing device for sealing a positive or negative pressure zone of a suction or blower roller of a machine which processes and/or produces web material, in particular a paper, cardboard or tissue machine. Here, the sealing strip has a front end side and a rear end side and an upper side which extends between the two end sides, the upper side providing a sealing face and a lubricant channel which is formed by way of a cutout from the sealing strip. In the sealing strip, a front wall is formed at the level of the lubricant channel between the front end side and the lubricant channel, and a rear wall which provides the sealing face and has a greater wall thickness than the front wall is formed between the lubricant channel and the rear end side.

During use as intended of the sealing strip, the sealing face can be set against the inner side of the roller shell and lubricant can be introduced into the inlet gap between the sealing face and the inner side of the roller shell by means of the lubricant channel in order to seal the positive or negative pressure zone, the roller shell running onto the sealing strip on the front end side and running away from it on the rear end side during a rotational movement of the roller shell.

The sealing strip according to the invention is distinguished by the fact that the sealing strip comprises a first material section which provides the sealing face and a second material section which provides the front wall at least in sections, the first material section being manufactured from a first material and the second material section being manufactured from a second material, and the first and the second material differing from one another in terms of at least one physical property, such as modulus of elasticity, abrasion resistance, hardness, brittleness.

It is possible by way of the solution according to the invention to adapt the sealing strip in an optimum manner with regard to the material selection to the requirements with regard to abrasion resistance of the sealing face and elasticity for the region of the front wall of the lubrication water channel.

Increased wear, as might be the case if the same material were used for the sealing face as for the material section which provides the front wall, can therefore be prevented. Cracking of the material section which provides the front wall can likewise be prevented, as might be the case if the same material were used for the material section which provides the front wall as for the sealing face.

The solution according to the invention does not necessarily demand that the entire front wall is provided by way of the second material section made from the second material, but rather it is also conceivable that the front wall is provided in sections by way of another material section, for example also by way of the first material section.

It is also to be mentioned that, if used as intended, the sealing strip is installed into the roller such that it is oriented with its longitudinal direction in the machine transverse direction of the roller.

Advantageous refinements and developments of the invention are specified in the subclaims.

Both the first material and the second material are preferably of elastic configuration. Here, the first material which provides the sealing face should be of elastic configuration in such a way that the sealing face can bear tightly against the inner side of the roller shell in order to provide a satisfactory sealing action. Dirt particles which are driven along with the roller shell can act on the second material section which provides the front wall. Since the second material section has an as a rule considerably smaller wall thickness in the region of the front wall (as viewed in the circumferential direction of the roller shell) than the first material section which provides the sealing face, the second material section is loaded with respect to mechanical actions to a more pronounced extent than the first material section. The second material should therefore preferably be of sufficient elastic configuration that it can absorb mechanical loads which act on the front wall, for example as a result of impacts on account of dirt particles which are driven along on the roller shell, without damage of the second material section. Tests of the applicant have shown that it is particularly advantageous if the second material has a smaller modulus of elasticity than the first material. In specific terms, the first material can have a modulus of elasticity of 10 000 $N/mm^2$ or more at room temperature. Furthermore, it is conceivable in this context that the second material has a modulus of elasticity of 8000 $N/mm^2$ or less, preferably 5000 $N/mm^2$ or less, at room temperature.

Furthermore, it is advantageous if the second material is less hard and/or brittle than the first material. As a result, the risk of cracking of the second material section which provides the front wall can be reduced.

Tests of the applicant have shown further that, in particular if the second material section which provides the front wall is brought into frictional contact with the inner side of the roller shell, it is appropriate if, in a friction pairing with the material of the inner side of the roller shell (in the case of sliding friction), the first material has the same or a greater abrasion resistance than the second material. This ensures that the second material section which provides the front wall is subject to at least as pronounced wear as the sealing face. This avoids the function of the sealing strip, in particular the sealing face, being impaired by way of jamming of the second material section on the inner side of the roller shell.

The requirement of as low a coefficient of friction as possible in the friction pairing with the material of the inner side of the roller shell (as a rule, steel) is made of the first material which provides the sealing face. It is conceivable in this context, in particular, that the first material in the friction pairing with the material of the inner side of the roller shell has a coefficient of friction of 0.15 or less. The results show that it is advantageous if the second material has a greater coefficient of friction than the first material. It is conceivable here that the second material in the friction pairing with the material of the inner side of the roller shell (as a rule, steel) has a coefficient of friction of 0.18 or more.

In specific terms, the first material can be one which comprises a plastic/graphite mixture, in particular a rubber/graphite mixture, as essential constituent part. It is conceivable, in particular, that the first material is formed by a rubber/graphite mixture. Here, for example, mixing ratios of from 45 to 80% by weight graphite and 55 to 20% by weight plastic or rubber are conceivable, a higher self-lubricating effect being achieved in the case of mixing ratios with more graphite than plastic, but the graphite proportion must not be too high, since the material is otherwise too brittle.

The second material can be one which comprises a plastic, in particular polyphenylene ether (PPE), as essential constituent part.

If the term "essential constituent part" is used in the present case, it is to be understood to mean that said constituent part makes up the greatest component in percent by weight of the material.

The lubricant is preferably substantially water. The term "substantially" relates here to the possible option of the addition of lubricant additives to the water, water always representing the main constituent part (in relation to percent by volume) of a mixture of this type.

In specific terms, the first material section can form a main body which provides the rear wall and the sealing face, and the second material section can form a lip which provides the front wall, the lip being connected at a connecting point to the main body. It is preferably provided in this context, in particular, that the sealing strip, with the exception of possible feed line connectors for the lubricant feed, is formed merely from the main body and the lip. Furthermore, the lip is preferably more elastic, in particular more flexurally elastic than the main body.

In specific terms, it can be provided, furthermore, that the main body has a rear side which provides the rear end side of the sealing strip. Furthermore, it is conceivable that the main body has a front side with a first and a second section, the first section providing a part of the lubricant channel and the second section providing the connecting point, at which the lip is connected to the main body. An embodiment of this type can be produced particularly simply and inexpensively. In this case, the front end side of the sealing strip is provided by way of the lip.

It is also conceivable that, in addition to the first and second section, the front side of the main body has a third section which provides a part of the front end side of the sealing strip. In this case, a part of the front end side of the sealing strip is therefore provided by way of the main body and another part of the front end side of the sealing strip is provided by way of the lip. Since, in the case of sealing strips, the two end sides often serve as guide faces of the sealing strip in the sealing strip holder, which guide faces fix the movement direction of the sealing strip when it bears against the inner side of the roller shell, it is appropriate, in particular, if the transition between the lip and the main body is of planar configuration on the front end side, that is to say, for example, does not form a step or a shoulder.

A plurality of options are conceivable, such as it being possible for the lip to be connected to the main body. It is possible according to one option that the lip is connected releasably to the main body, in particular is connected to the main body in a non-positive and/or positively locking manner. Here, in particular, screw or joint connections are conceivable. By way of a releasable connection, it is possible without great complexity to exchange a damaged lip for a new lip.

If the first and the second material have different thermal length expansions with respect to one another, it may occur that, as viewed in the longitudinal direction of the sealing strip, the lip and the main body expand differently to one another. In order to reduce or prevent a deformation or curvature of the sealing strip in its longitudinal direction caused by way of different thermal length expansion of the main body and the lip, one preferred refinement of the invention therefore provides that the lip and the main body are connected to one another such that they can be moved relative to one another in the longitudinal direction of the sealing strip. In specific terms, this can be provided, for example, by way of a positively locking connection between the lip and the main body, for example in the form of a dovetail connection which permits a relative movement of the lip and the main body in the longitudinal direction of the sealing strip. It is to be noted at this point that the abovementioned relative mobility is conceivable not only in conjunction with different thermal length expansions of the lip and main body.

As an alternative to this, it is conceivable that the lip which is arranged on the main body is connected to the main body in a non-releasable manner, in particular in an integrally joined manner. As a result, a connection is provided which can be produced easily and therefore inexpensively, particularly in the manufacture of the sealing strip. For example, an adhesive connection is conceivable here.

In order to increase the stiffness of the lip against a load which is directed in the rotational movement direction of the roller shell, it is appropriate, in particular, if the sealing strip comprises reinforcing ribs, against which the lip is supported in the case of a rotational movement of the roller shell. It is conceivable in this context, in particular, that the reinforcing ribs are arranged on the lip. As an alternative or in addition to this, it is conceivable that the reinforcing ribs are arranged on the rear wall.

In order to ensure that folding over of the lip counter to the rotational movement direction of the roller shell does not take place during assembly of the sealing strip, which might result in damage of the lip and/or damage of the connecting point, it is provided according to one preferred refinement of the invention that the lip is configured in such a way that, in the case of use as intended, it runs in an inclined and/or curved manner with respect to the radial direction of the roller shell, the inclination and/or curvature being directed in the movement direction of the roller.

As an alternative to this, it is conceivable that the lip is configured in such a way that, in the case of use as intended, it runs substantially in the radial direction of the roller shell. A lip of this type can be manufactured particularly simply and therefore inexpensively.

It is provided according to one specific refinement of the invention that, as viewed in the circumferential direction of the roller shell, the sealing face has an extent of from 15 mm to 70 mm, in particular from 15 mm to 50 mm. Furthermore, it is provided according to a further specific refinement of the invention that, as viewed in the circumferential direction of the roller shell, the lip has a wall thickness of from 0.5 mm to 6 mm.

As has already been explained above, it can be appropriate, in order to provide a satisfactory lubricant supply between the sealing face and the roller shell inner side, if the lip is designed in such a way that, in the case of use as intended of the sealing strip in the state in which the sealing face is set against the inner side of the roller shell, the upper edge lip is set against the inner side of the roller shell, that is to say is in frictional contact with the inner side of the roller shell during a rotational movement of the latter, or is spaced apart from the inner side of the roller shell by at most 10 mm, preferably at most 4 mm. When set against said inner side, the lip then functions in the manner of a "sealing lip" or a "wiper blade" and seals the lubricant channel to the front, with the result that the lubricant either remains in the lubricating channel or is drawn into the inlet gap of the sealing face and the roller shell inner side, but can escape from the lubricant channel only a little elsewhere. Furthermore, the circumstance that the lip is set against the roller shell inner side can occur only after a certain operating time, for example during the wearing of the sealing face, and does not absolutely necessarily have to already be the case at the start of the operating time of the sealing strip.

For a satisfactory lubricant supply, it can be appropriate, furthermore, if the lubricant channel extends in an inclined manner from its bottom towards the sealing face, the inclination being directed in the direction of the rear end side of the sealing strip, in particular enclosing an angle between 20° and 70°, in particular between 30° and 50°, with a horizontal.

As a result, the lubricant can be transported particularly easily along the oblique plane which is formed by way of the rear wall into the inlet gap between the sealing face and the roller shell inner side. This effect is largely pronounced, in particular, when the lubricant channel is filled with the lubricant up to or virtually up to the inner side of the roller shell and, as a result, is entrained by way of the inner side of the roller shell.

In order to achieve satisfactory lubrication of the sealing face/inner side of the roller shell friction pairing with the lubricant over the substantially entire length of the sealing strip, one preferred refinement of the invention provides that the lubricant channel extends over the greatest part of the length of the sealing strip.

One option for supplying the lubricant channel with lubricant provides that the sealing strip comprises a lubricant distribution system which is guided within the sealing strip, with a lubricant feed channel which extends in the longitudinal direction of the sealing strip and one or a plurality of riser line(s) which is/are connected on one end side to the lubricant channel and on the other end side to the lubricant feed channel, said riser lines being arranged next to one another in the longitudinal direction of the lubricant channel in the case of the plurality of riser lines. The lubricant channel can be connected to a lubricant feed line which is conducted outside the sealing strip.

The sealing strip according to the invention can be used at a wide variety of positions in any type of suction or blower rollers for machines which process and/or produce web material, in particular paper, cardboard or tissue machines.

The sealing strip according to the invention can be used particularly advantageously in positions, in which the lubricant channel is not arranged "upside down" with the opening at the bottom, since, in the case of an "upside down" orientation of the lubricant channel, the function of the lubricant channel is taken benefit of to a lesser extent, since, in this case, it can serve less as a reservoir for the lubricant than when the opening of the channel is directed upward.

One independent aspect of the invention which is based on this finding therefore proposes a suction or blower roller having a sealing device for sealing a positive or negative pressure zone of the suction or blower roller by way of at least one sealing strip as claimed in one of claims 1 to 13, in which the sealing strip is installed in the suction or blower roller, as viewed in a plane which is defined by the rotational movement of the roller shell, in a position between 7 o'clock and 12 o'clock if the rotational movement of the roller shell is in the clockwise direction and in a position between 5 o'clock and 12 o'clock, if the rotational movement direction of the roller shell is counter to the clockwise direction.

BRIEF DESCRIPTION OF THE SEVERAL VIEWS OF THE DRAWING

In the following text, the invention will be explained further using diagrammatic drawings which are not true to scale and in which.

DESCRIPTION OF THE INVENTION

The sealing strips of the generic type have a longitudinal direction which, in the case of use as intended of the sealing strips, extends in the machine transverse direction of the roller, into which they are installed. The sealing strips 1, 1*a*, 1*b*, 1*c* which are shown in FIGS. 1-4 are shown in a cross-sectional plane which is defined perpendicularly with respect to the longitudinal direction of the sealing strips 1, 1*a*, 1*b*, 1*c*. In the case of use as intended of the sealing strips of the generic type, furthermore, the rotational movement direction of the roller shell runs in the abovementioned cross-sectional plane.

Figure 1:
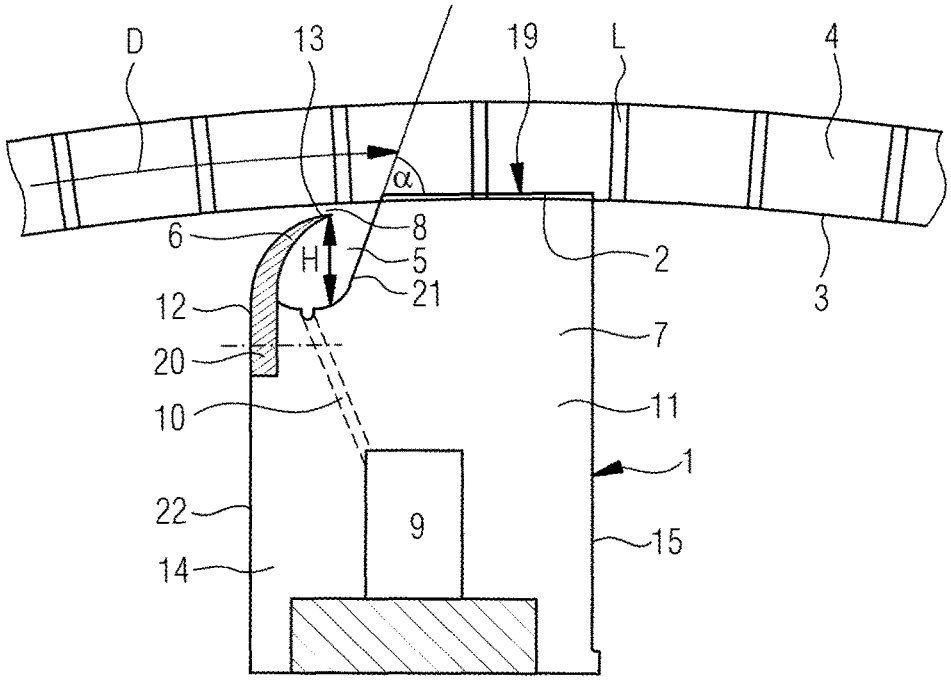
FIG. 1 shows a first embodiment of a sealing strip according to the invention in a suction roller of a paper, cardboard or tissue machine.

FIG. 1 shows a sealing strip 1 in the case of use as intended in a sealing device (not shown in further detail) of a suction roller of a machine which processes and/or produces web material.

The sealing strip 1 has a front end side 14 and a rear end side 15, and an upper side 19 which extends between the two end sides 14, 15 and provides a sealing face 2 and a lubricant channel 5 which is formed by way of a cutout from the sealing strip 1. As can be seen from the illustration of FIG. 1, the lubricant channel 5 is arranged between the front end side 14 and the sealing face 2. It can be seen from FIG. 1, furthermore, that a front wall 6 is formed at the level H of the lubricant channel 5 between the front end side 14 and the lubricant channel 5, and a rear wall 7 which provides the sealing face 2 is formed between the lubricant channel 5 and the rear end side 15, the rear wall 7 (as viewed in the circumferential direction of a roller shell 4) having a greater wall thickness than the front wall 6.

In the case of use as intended of the sealing strip 1, in order to seal the positive or negative pressure zone, the sealing face 2 can be set against the inner side 3 of the roller shell 4 which comprises a multiplicity of suction holes L, and is in frictional contact with said inner side 3 of the roller shell 4 during a rotational movement D of the roller shell 4. A lubricant (in the form of water in the present case) can be introduced into the inlet gap 8 between the sealing face 2 and the inner side 3 of the roller shell 4 by means of the lubricant channel 5 which is open toward the inner side 3 of the roller shell 4. Furthermore, during a rotational movement D of the roller shell 4, the roller shell 4 runs onto the sealing strip 1 on the front end side 14 and runs off of said sealing strip 1 again on the rear end side 15. As viewed in the rotational movement direction D of the roller shell, the lubricant channel 5 is arranged in front of the sealing face 2 and the front wall 6 is arranged in front of the rear wall 7.

Furthermore, the sealing strip 1 has a lubricant distribution system which is conducted within the sealing strip 1, with a lubricant feed channel 9 which extends in the longitudinal direction of the sealing strip 1 and a multiplicity of riser lines 10 (of which only one can be seen in the illustration of FIG. 1). The riser lines 10 are connected on one end side to the lubricant channel 5 and on the other end side to the lubricant feed channel 9 and are arranged next to one another in the longitudinal direction of the lubricant channel 5.

The sealing strip 1 which is shown in FIG. 1 is formed by way of a first material section which is made from a first material and forms a main body 11, and a second material section which is made from a second material and forms a flexurally elastic lip 12. Here, the main body 11 provides the rear wall 7 with the sealing face 2. Furthermore, the lip 12 provides the front wall 6. In the present case, the first and the second material differ from one another at least in terms of the physical properties modulus of elasticity, abrasion resistance and coefficient of friction. Specifically, the first material comprises substantially a rubber/graphite mixture and has a graphite proportion of 60% by weight and a rubber proportion of 35% by weight, and further constituent parts. The second material comprises polyphenylene ether (PPE) as a substantial constituent part. The first material has a modulus of elasticity of approximately 14 000 $N/mm^2$ and the second material has a modulus of elasticity of approximately 2400 $N/mm^2$. The second material therefore has a smaller modulus of elasticity than the first material.

Furthermore, the first material and the second material are adapted to one another in such a way that, in a friction pairing with the material of the inner side 3 of the roller shell 4 (this is steel in the present case) in the case of sliding friction, the first material has a smaller coefficient of friction (namely 0.125) than the second material (namely 0.2).

As can be seen from the illustration of FIG. 1, the lip 12 is designed in such a way that, in the case of use as intended of the sealing strip 1 in the state in which the sealing face 2 is set against the inner side 3 of the roller shell 4, the upper edge 13 lip 12 is set against the inner side 3 of the roller shell 4 and is in frictional contact with the latter. Furthermore, the lip 12 runs in a curved manner as viewed in the movement direction D of the roller shell 4. This can be produced by the lip 12 already being manufactured in a curved manner or else by the lip, without an inherent curvature, experiencing a force which curves it on account of the friction with the roller shell inner side 3. In the last-mentioned case, the lip is presently manufactured in such a way that, in the state in which the sealing face 2 is not set against the roller shell inner side 3, its upper edge 13 projects at the level above the sealing face 2.

In the present case, the lip can be connected releasably at a connecting point 20 to the main body 11, for example in a non-positive manner in the form of a screw connection. In the exemplary embodiment which is shown in FIG. 1, the main body 11 forms the rear end side 15 of the sealing strip 1, furthermore.

Furthermore, the main body 11 has a front side which has a first section 21, a second section 20 and a third section 22, the first section providing a part of the lubricant channel 5, the second section providing the connecting point 20, at which the lip 12 is connected to the main body 11, and the third section 22 providing a part of the front end side 14 of the sealing strip 1.

Accordingly, in the present case, the front end side 14 of the sealing strip 1 is provided by way of the lip 12 and the third section 22 of the front side of the main body 11. It can be seen, furthermore, that the transition between the lip 12 and the main body 11 on the front end side 14 is of planar configuration, that is to say, for example, does not form a step or a shoulder.

It is to be noted that, in all the sealing strips 1, 1*a*, 1*b*, 1*c* which are shown in FIGS. 1-4, the lubricant channel 5 extends in a manner which is inclined from its bottom toward the sealing face, the inclination enclosing an angle between 20° and 70° with a horizontal. Furthermore, in all the sealing strips 1, 1*a*, 1*b* which are shown in FIGS. 1-4 and 5, the lubricant channel 5 extends over the greatest part of the length of the respective sealing strip 1, 1*a*, 1*b*, 1*c*.

Figure 2:
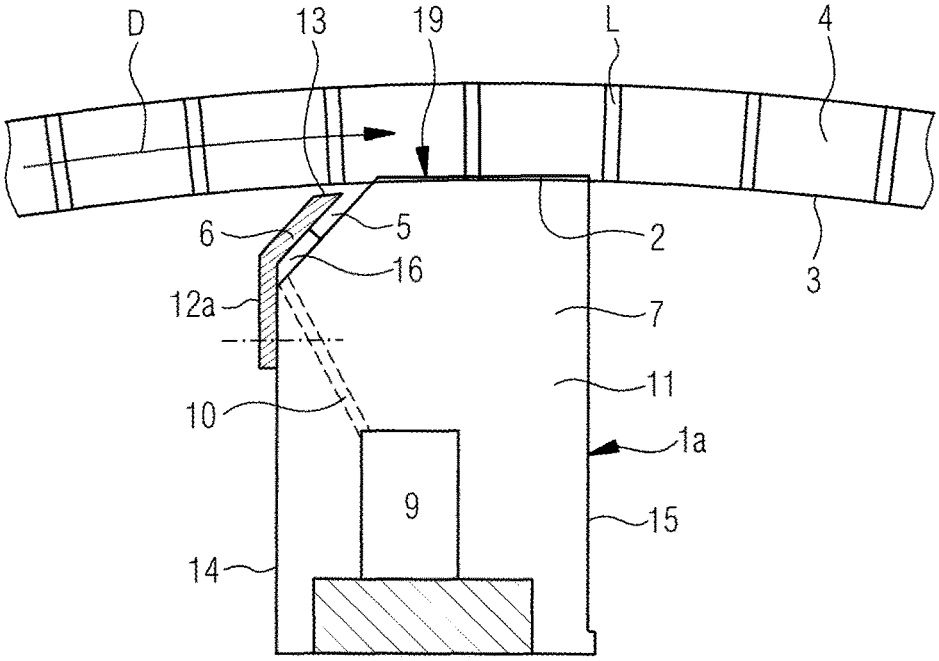
FIG. 2 shows a second embodiment of a sealing strip according to the invention in a suction roller of a paper, cardboard or tissue machine.
Figure 3:
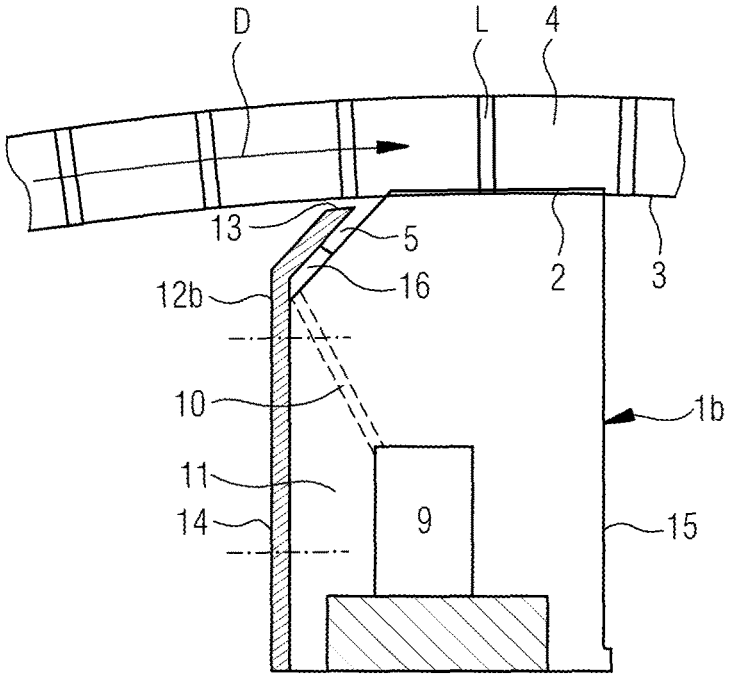
FIG. 3 shows a third embodiment of a sealing strip according to the invention in a suction roller of a paper, cardboard or tissue machine.
Figure 4:
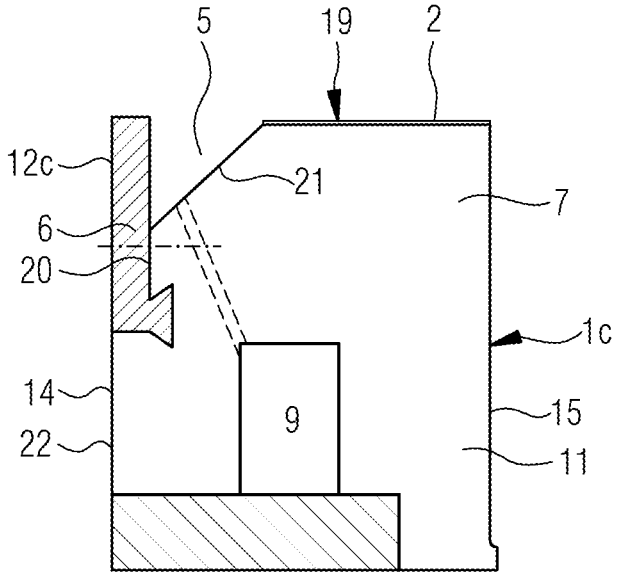
FIG. 4 shows a fourth embodiment of a sealing strip according to the invention in a suction roller of a paper, cardboard or tissue machine.

In the alternative refinements of the sealing strips according to the invention which are shown in FIGS. 2 to 4, only the differences from the sealing strip 1 which is shown in FIG. 1 are to be addressed.

The sealing strip 1*a* which is shown in FIG. 2 comprises a plurality of reinforcing ribs 16 which are arranged next to one another in the longitudinal direction of the sealing strip and against which the lip 12*a* is supported during a rotational movement D of the roller shell 4, by the lip 12 being pressed by way of the reinforcing ribs 16 against the rear wall 7. In the present case, the reinforcing ribs 16 are arranged on the lip 12*a*.

As can be seen from the illustration of FIG. 2, the lip 12*a* is designed in such a way that, in the case of use as intended of the sealing strip 1*a* in the state in which the sealing face 2 is set against the inner side 3 of the roller shell 4, the upper edge 13 lip 12*a* is spaced apart from the inner side 3 of the roller shell 4, the spacing being from 2-4 mm in the present case. Furthermore, the lip 12 runs in an inclined manner as viewed in the movement direction D of the roller shell 4, the lip 12' already being manufactured in an inclined manner.

Furthermore, it can be seen in the sealing strip 1*a* which is shown in FIG. 2 that the transition between the lip 12*a* and the main body 11 on the front end side 14 is formed by way of a shoulder.

The sealing strip 1*b* which is shown in FIG. 3 differs from that of FIG. 2 merely in that the front end side 14 is provided completely by way of the lip 12*b*'. As a result, a planar front end side 14 is likewise provided.

FIG. 4 shows a further sealing strip 1*c* according to the invention in a cross-sectional plane which is perpendicular with respect to its longitudinal direction. In contrast to the sealing strips 1, 1*a* and 1*b* which are shown in FIGS. 1 to 3, the lip 12*c* of the sealing strip 1*c* which is shown in FIG. 4 is configured in such a way that, in the case of use as intended, it extends substantially in the radial direction of the roller shell 4. However, FIG. 4 shows the sealing strip 1*c* in the non-installed state, that is to say without a roller shell.

Furthermore (this is the same as in the case of the sealing strip 1 which is shown in FIG. 1), the main body 11 has a rear side which provides the rear end side 15 of the sealing strip 1*c*. Furthermore, the main body 11 has a front side with a first section 21, a second section 20 and a third section 22, the first section 21 providing a part of the lubricant channel 5, the second section 20 providing the connecting point of the main body 11 to the lip 12*c*, and the third section 22 providing a part of the front end side 14 of the sealing strip 1*c*. This means that, in the embodiment which is shown in FIG. 4, the front end side 14 of the sealing strip is formed in sections by way of the lip 12*c* and in sections by way of the main body 11, the transition between the lip 12*c* and the main body 11 on the front end side 14 being of planar configuration, that is to say without a step or shoulder. Furthermore, the rear end side 15 of the sealing strip 1*c* is formed merely by way of the main body 11. In the present case, the sealing strip 1*c* which is shown in FIG. 4 is formed merely from the main body 11 and the lip 12*c*, that section of the lubricant channel 5 which extends from the channel bottom to the sealing face 2 being formed by way of the first section 21 of the main body 11 and running as an oblique plane in a manner which is inclined at an angle from approximately 40° to 50° with respect to the horizontal.

In the sealing strip 1*c* which is shown in FIG. 4, furthermore, the lip 12*c* is connected in a positively locking manner to the main body 11 at the connecting point 20. Here, the connecting point 20 forms a dovetail connection which permits a relative mobility of lip 12*c* and main body 11 in the longitudinal direction of the sealing strip 1*c*, that is to say in the machine transverse direction of the roller in the case of use as intended thereof, but substantially or completely prevents relative mobility in other directions than the one mentioned above. This embodiment is appropriate, in particular, when the lip 12*c* and the main body 11 have a different thermal length expansion from one another in the longitudinal direction of the sealing strip 1*c*.

Figure 5:
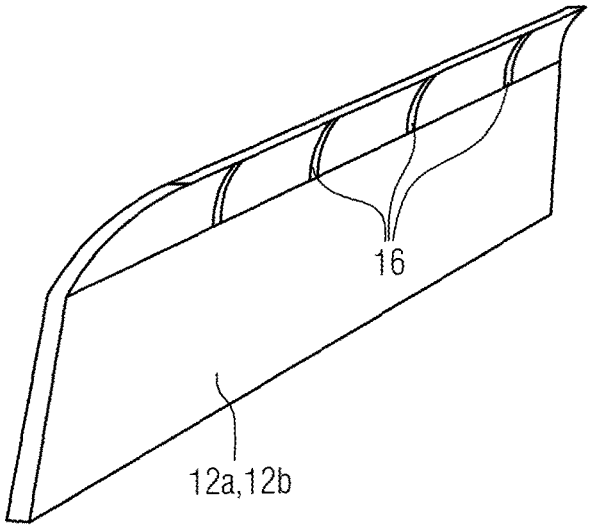
FIG. 5 shows a lip of a sealing strip according to the invention in a perspective view.

FIG. 5 shows the lip 12*a* or 12*b* in a perspective view with the plurality of reinforcing ribs 16 which are arranged next to one another in the longitudinal direction of the lip 12*a*, 12*b*.

Figure 6:
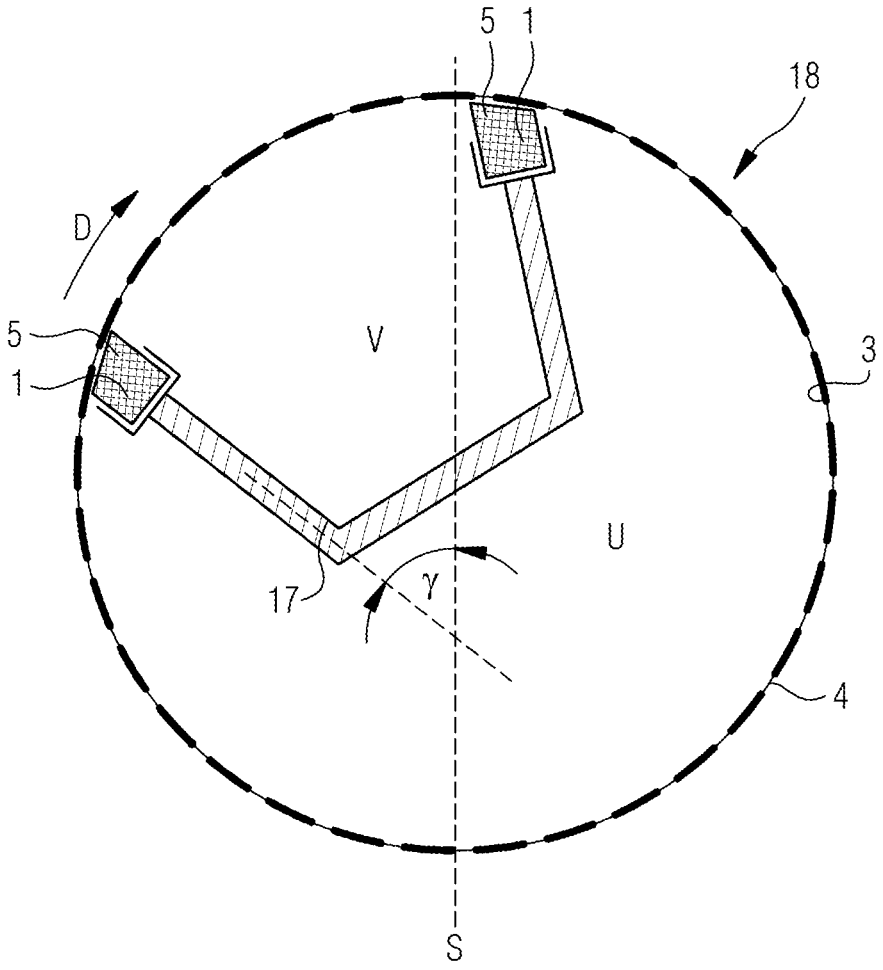
FIG. 6 shows a suction roller according to the invention.

A suction or blower roller for a machine which processes and/or produces web material, in particular a paper, cardboard or tissue machine, having a sealing device for sealing a positive or negative pressure zone of the suction or blower roller, the sealing device comprising at least one sealing strip as claimed in one of claims 1 to 14. FIG. 6 shows a suction roller 18 according to the invention for a machine which processes and/or produces web material, in particular a paper, cardboard or tissue machine, in a cross-sectional plane perpendicularly with respect to the longitudinal direction of the suction roller 18. It is to be noted that the longitudinal direction of the sealing strip 1 or 1*a* or 1*b* or 1*c* and that of the suction roller 18 coincide.

According to the second aspect of the invention, the suction roller 18 has at least one sealing device 17 for sealing a negative pressure zone V of the suction roller 18 with respect to the surroundings U. Here, the sealing device 17 comprises at least one sealing strip 1, 1*a*, 1*b* or 1*c*; two sealing strips according to the invention in the present case. According to the invention, the two sealing strips 1, 1*a* or 1*b* are installed in the suction roller 18, as viewed in the cross-sectional plane or in a plane which is defined by the rotational movement D of the roller shell 4, in a position from 7 o'clock to 12 o'clock in the case of a rotation in the clockwise direction and in a position from 5 o'clock to 12 o'clock in the case of a rotation counter to the clockwise direction.

In the embodiment which is shown in FIG. 6, the rotation D of the roller shell takes place in the clockwise direction and the two sealing strips 1, 1*a*, 1*b* or 1*c* are installed into the roller 18 in a 10 o'clock position. The two sealing strips 1, 1*a*, 1*b* or 1*c* are installed into the roller 18 as intended, that is to say, as viewed in the rotational movement direction D of the roller shell 4, the lubricant channel 5 is arranged in front of the sealing face 2 and the front wall 6 is arranged in front of the rear wall 7.

The invention claimed is:

1. A sealing strip suitable for a sealing device for sealing a positive or negative pressure zone of a suction or blower roller of a machine for processing and/or producing web material, the sealing strip comprising:

a front end side, a rear end side, and an upper side extending between said front and rear end sides, said upper side being a sealing face and having a lubricant channel being a cutout formed in the sealing strip;

a front wall formed at a level of said lubricant channel between said front end side and said lubricant channel;

a rear wall forming said sealing face and having a greater wall thickness than said front wall being formed between said lubricant channel and said rear end side;

wherein, during an intended use of the sealing strip, said sealing face is set against an inner side of a roller shell of the suction or blower roller in order to seal the positive or negative pressure zone, and lubricant is introduced into an inlet gap between said sealing face and the inner side of the roller shell by way of said lubricant channel, and wherein, during a rotational movement of the roller shell, the roller shell runs onto the sealing strip at said front end side and runs away from the sealing strip on said rear end side;

a first material section of the sealing strip being formed of a first material and providing said rear wall in a region of said sealing face and a second material section of the sealing strip being formed of a second material and providing said front wall at least in sections; and said first and second material sections differing from one another in terms of at least one physical property selected from the group consisting of a modulus of elasticity, an abrasion resistance, a hardness and a brittleness; and said first material and said second material are adapted to one another such that, in a friction pairing with the material of the inner side of the roller shell and in sliding friction, said first material has a greater abrasion resistance than said second material.

2. The sealing strip according to claim 1, wherein said second material has a smaller modulus of elasticity than said first material.

3. The sealing strip according to claim 1, wherein said first material is more brittle and/or harder than said second material.

4. The sealing strip according to claim 1, wherein said first material and said second material are adapted to one another such that, in a friction pairing with a material of the inner side of the roller shell and in sliding friction, said first material has a smaller coefficient of friction than said second material.

5. The sealing strip according to claim 1, wherein said first material comprises a rubber/graphite mixture as an essential constituent part thereof.

6. The sealing strip according to claim 1, wherein said second material comprises a plastic material as an essential constituent part thereof.

7. The sealing strip according to claim 6, wherein said plastic material is polyphenylene ether (PPE).

8. The sealing strip according to claim 1, wherein said first material section forms a main body that provides said rear wall with said sealing face, and said second material section forms a lip that provides said front wall and is mounted to said main body.

9. The sealing strip according to claim 8, wherein said lip is configured such that, in a case of an intended use of the sealing strip, with said sealing face set against the inner side of the roller shell, an upper edge of said lip is set against the inner side of the roller shell.

10. The sealing strip according to claim 8, wherein said lip is configured such that, in a case of an intended use of the sealing strip, with said sealing face set against the inner side of the roller shell, an upper edge of said lip is spaced apart from the inner side of the roller shell by no more than 10 mm.

11. The sealing strip according to claim 8, wherein said lip is configured such that, in a case of an intended use of the sealing strip, with said sealing face set against the inner side of the roller shell, an upper edge of said lip is spaced apart from the inner side of the roller shell by no more than 4 mm.

12. The sealing strip according to claim 8, wherein said lip is connected releasably to the main body by way of a non-positive and/or a positive locking engagement.

13. The sealing strip according to claim 8, which comprises a plurality of reinforcing ribs arranged next to one another in a longitudinal direction of the sealing strip and supporting said lip during a rotational movement of the roller shell.

14. The sealing strip according to claim 8, wherein a transition between said lip and said main body has a planar configuration on said front end side.

15. The sealing strip according to claim 1, wherein said rear wall is inclined from a lowest point of said lubricant channel toward said sealing face, with an inclination being directed in the direction of said rear end side.

16. The sealing strip according to claim 15, wherein said inclination towards said rear end side encloses an angle of between 20° and 70° with a horizontal.

17. The sealing strip according to claim 16, wherein said inclination towards said rear end side encloses an angle of between 30° and 50° with the horizontal.

18. The sealing strip according to claim 1, wherein said lubricant channel extends over a greatest part of a length of said sealing strip.

19. A suction or blower roller for a machine for processes or producing web material, comprising:

a sealing device for sealing a positive or negative pressure zone of the suction or blower roller, said sealing device including at least one sealing strip according to claim 1;

wherein said sealing strip is installed in the suction or blower roller, as viewed in a plane which is defined by a rotational movement of a roller shell, in a position between 7 o'clock and 12 o'clock, if a rotational movement direction of the roller shell is in the clockwise direction and in a position between 5 o'clock and 12 o'clock, if the rotational movement direction of the roller shell is in the counter-clockwise direction.

20. A sealing strip suitable for a sealing device for sealing a positive or negative pressure zone of a suction or blower roller of a machine for processing and/or producing web material, the sealing strip comprising:

a front end side, a rear end side, and an upper side extending between said front and rear end sides, said upper side being a sealing face and having a lubricant channel being a cutout formed in the sealing strip;

a front wall formed at a level of said lubricant channel between said front end side and said lubricant channel;

a rear wall forming said sealing face and having a greater wall thickness than said front wall being formed between said lubricant channel and said rear end side;

wherein, during an intended use of the sealing strip, said sealing face is set against an inner side of a roller shell of the suction or blower roller in order to seal the positive or negative pressure zone, and lubricant is introduced into an inlet gap between said sealing face and the inner side of the roller shell by way of said lubricant channel, and wherein, during a rotational movement of the roller shell, the roller shell runs onto the sealing strip at said front end side and runs away from the sealing strip on said rear end side;

a main body of the sealing strip being formed of a first material and providing said rear wall in a region of said sealing face;

a lip element mounted to said main body and providing said front wall, at least in sections, said lip element being formed of a second material; and said main body and said lip element differing from one another in terms of at least one physical property selected from the group consisting of a modulus of elasticity, an abrasion resistance, a hardness and a brittleness.

21. The sealing strip according to claim 20, wherein said first material and said second material are adapted to one another such that, in a friction pairing with the material of the inner side of the roller shell and in sliding friction, said first material has a greater abrasion resistance than said second material.

22. The sealing strip according to claim 20, wherein said lip element is a separate element being a flexurally elastic lip attached to said main body.

* * * * *